US006299165B1

(12) United States Patent
Nagano

(10) Patent No.: US 6,299,165 B1
(45) Date of Patent: Oct. 9, 2001

(54) DIVIDEDLY PAYING GAME MACHINE

(75) Inventor: Hiroyuki Nagano, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/533,730

(22) Filed: Mar. 23, 2000

(30) Foreign Application Priority Data

Mar. 23, 1999 (JP) ..... 11-077116

(51) Int. Cl.[7] ..... G07F 17/34

(52) U.S. Cl. ..... 273/143 R; 273/138.2; 463/20

(58) Field of Search ..... 463/20, 12, 13; 273/143 R, 138.2, 138 A

(56) References Cited

U.S. PATENT DOCUMENTS 5,393,057 * 2/1995 Marnell, II ..... 273/85 CP
5,449,173 9/1995 Thomas et al. .
5,775,692 * 7/1998 Watts et al. ..... 273/143 R
5,848,932 * 12/1998 Adams ..... 463/20

FOREIGN PATENT DOCUMENTS

0874337-A1 * 10/1998 (FR) ..... G07F/17/32
2222712-A * 3/1990 (GB) ..... G07F/17/34

* cited by examiner

*Primary Examiner*—Benjamin H. Layno
(74) *Attorney, Agent, or Firm*—Pillsbury Winthrop LLP

(57) ABSTRACT

In a game machine, when a result of hit determination is a hit of double odds, a motor drive circuit 36 is controlled, any one of stepping motor 37 through 39 of reels 3 through 5 including a symbol "wild" is driven to rotate and any one of the reels 3 through 5 including the symbol "wild" is rotated by one rotation (step 109). Next, a hopper 49 is driven by a hopper drive circuit 48 and coins having a number of sheets of a normal hit in accordance with an allotment display table are paid to a coin tray 20 (step 110). Next, any one of the reels 3 through 5 including the symbol "wild" is again rotated by one rotation (step 111). Thereafter, coins of the normal hit in accordance with the allotment display table are again paid (step 112).

7 Claims, 7 Drawing Sheets

Fig.3

| | 1st Coin | 2nd Coin | 3rd Coin |
|---|---|---|---|
| WILD WILD WILD | 250 | 500 | 1000 |
| 7 7 7 | 150 | 300 | 450 |
| BAR BAR BAR / BAR BAR BAR / BAR BAR BAR | 80 | 160 | 240 |
| BAR BAR / BAR BAR / BAR BAR | 50 | 100 | 150 |
| BAR BAR BAR | 20 | 40 | 60 |
| ANY BAR ANY BAR ANY BAR | 10 | 20 | 30 |
| ANY 2 | 5 | 10 | 15 |
| ANY 1 | 2 | 4 | 6 |

DIVIDEDLY PAYING GAME MACHINE

This patent application claims priority based on the Japanese patent applications, H11-077116 filed on Mar. 23, 1999 and the contents of which is incorporated herein by reference.

BACKGROUND OF THE INVENTION

1. Field of the Invention

The present invention relates to a game machine in which a hit is produced when a combination of predetermined picture patterns is stopped to display on a hit line and which pays game media of an amount in accordance with a kind of the hit to a player.

2. Related Art

Conventionally, there is, for example, a slot machine as a game machine of this kind. A slot machine game is started by putting medals into a slot machine or betting medals on a slot machine within a range of a number of credited medals and operating a start lever by a player. When the start lever is operated by the player, reels constituting a variable display apparatus starts rotating, thereafter, rotational display of the reels is stopped.

At this occasion, when a combination of picture patterns indicated on an allotment display table is arranged on a hit line, there is produced a hit in accordance with a kind of the combination of picture patterns. Further, a number of medals in accordance with the kind are paid to a receiving tray or the number of medals are stored at inside of the machine as credit.

According to such a conventional slot machine, when a hit is produced, a number of medals in accordance with hit odds thereof are actually paid simultaneously to a receiving tray or are simultaneously paid as credit and a numerical display of the credit is instantaneously increased.

Therefore, when the number of sheets of payment is a large amount such as several hundreds sheets, during the payment operation, the player is obliged to simply look at all of medals being paid to the receiving tray at a constant speed and experiences a monotonous awaiting time period until the payment is finished.

Meanwhile, when medals are paid as credit, even when a large amount of medals are gained, a numerical value of credit is simply increased instantaneously and accordingly, the pleasure cannot be experienced sufficiently.

SUMMARY OF THE INVENTION

The present invention has been carried out in order to address such a problem and according to an aspect of the invention, there is provided a game machine having a variable display apparatus for variably displaying various picture patterns in a plurality of columns, producing a hit when a predetermined combination of the picture patterns is stopped to display on a hit line and paying game media of an amount in accordance with a kind of the hit to a player, wherein the game machine comprises dividedly paying means for paying the game media of one hit dividedly in plural times, and display staging means for staging a display to the player between payments by the dividedly paying means, for example, the variable display apparatus.

According to the constitution, even when an amount of game media to be paid is large, the game media are paid dividedly in plural times by the dividedly paying means, the display staging means stages the display to the player between payments and accordingly, there is provided a variation in payment operation and the player can enjoy staging of the display during the payment operation.

Further, by dividing payment as credit in this way, increasing in steps a numerical value of credit in plural times and staging the display by the display staging means between increases of the respective numerical values of credit, in comparison with the conventional case in which the numerical value of credit is simultaneously increased the player can actually feel that the large amount of the game media are gained.

Further, according to another aspect of the present invention, there is provided a game machine wherein the dividedly paying means pays the game media of one hit dividedly in plural times when a predetermined one of the combinations of picture patterns including a specific picture pattern is stopped to display on the hit line.

By such a constitution, in the case in which the payment is divided by the dividedly paying means when the specific picture pattern is stopped to display on the hit line, the player pays attention to the specific picture pattern and a degree of recognizing the specific picture pattern is promoted.

Further, according to another aspect of the invention, there is provided a game machine wherein the display staging means stages the display of the variable display apparatus by executing a variable display of the columns including the specific picture pattern.

According to the constitution, by variably displaying the column including the specific picture pattern, the player pays further attention to the specific picture pattern and the degree of recognizing the specific pattern is further promoted.

Further, according to another aspect of the invention, there is provided a game machine wherein the dividedly paying means pays the game media of one hit dividedly in a multiple of odds allotted to the specific picture pattern when the specific picture pattern constitutes the odds for multiplying an amount of paying the game media to the hit by the multiple.

According to the constitution, by dividing payment in the multiple of the odds allotted to the specific pattern by the dividedly paying means, meaning of the odds of the specific picture pattern is made clear.

Further, according to another aspect of the invention, there is provided a game machine wherein the display staging means executes one time variable display of the columns including the specific picture pattern of the variable display apparatus by the multiple of odds allotted to the specific picture pattern when the specific pattern constitutes the odds for multiplying an amount of paying the game media to the hit by the multiple.

According to the constitution, by variably displaying the column including the specific picture pattern by the multiple of the odds allotted to the specific picture pattern by the display staging means, the meaning of the odds of the specific picture pattern is made further clear.

BRIEF DESCRIPTION OF THE DRAWINGS

FIG. 3 is a diagram showing an allotment display table appearing on top glass of the slot machine according to the embodiment;

DESCRIPTION OF THE PREFERRED EMBODIMENT

Next, an explanation will be given of an embodiment in which a game machine according to the invention is applied to a slot machine.

Figure 1:
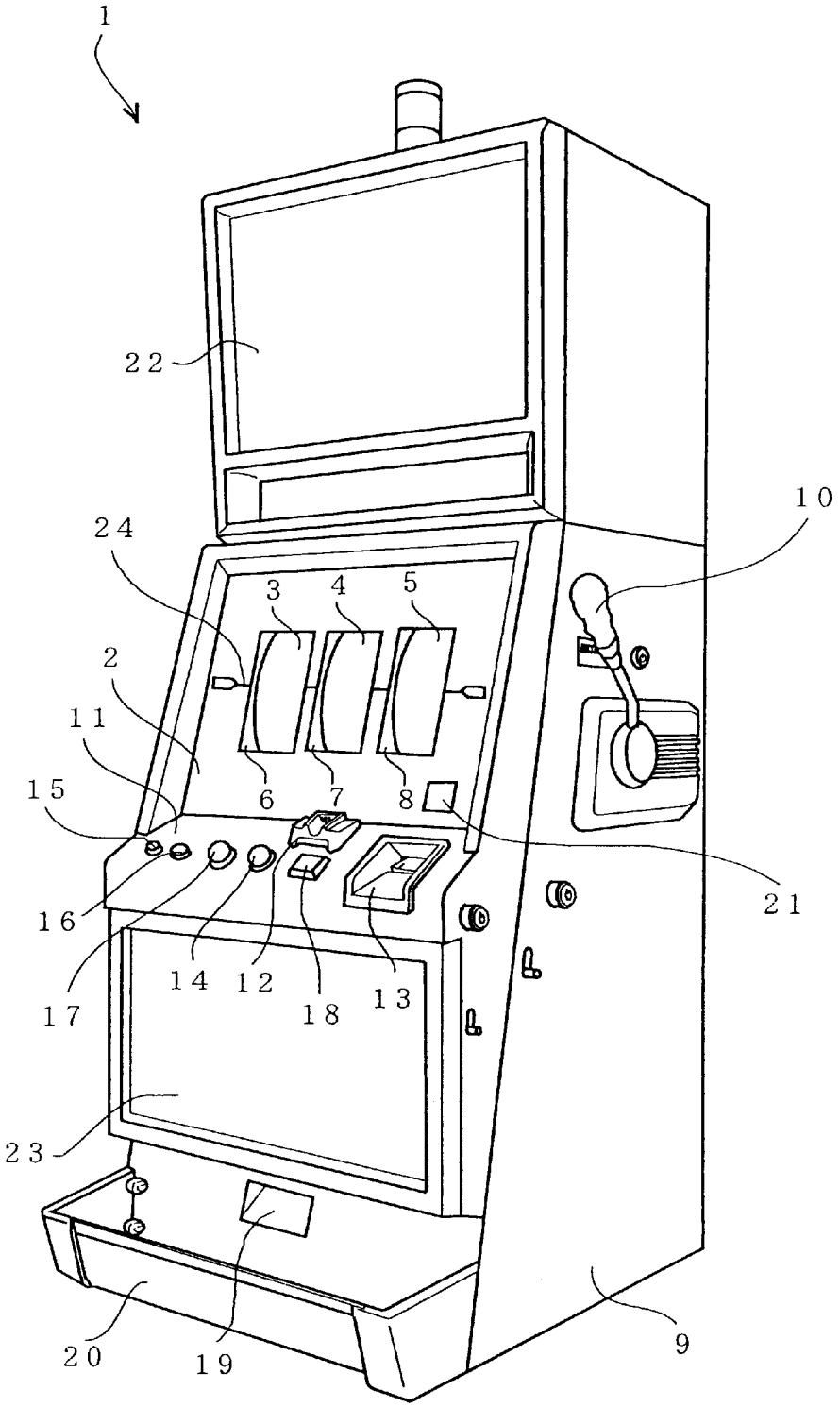
FIG. 1 is a perspective view showing an outlook of a slot machine according to an embodiment of the invention.
Figure 2:
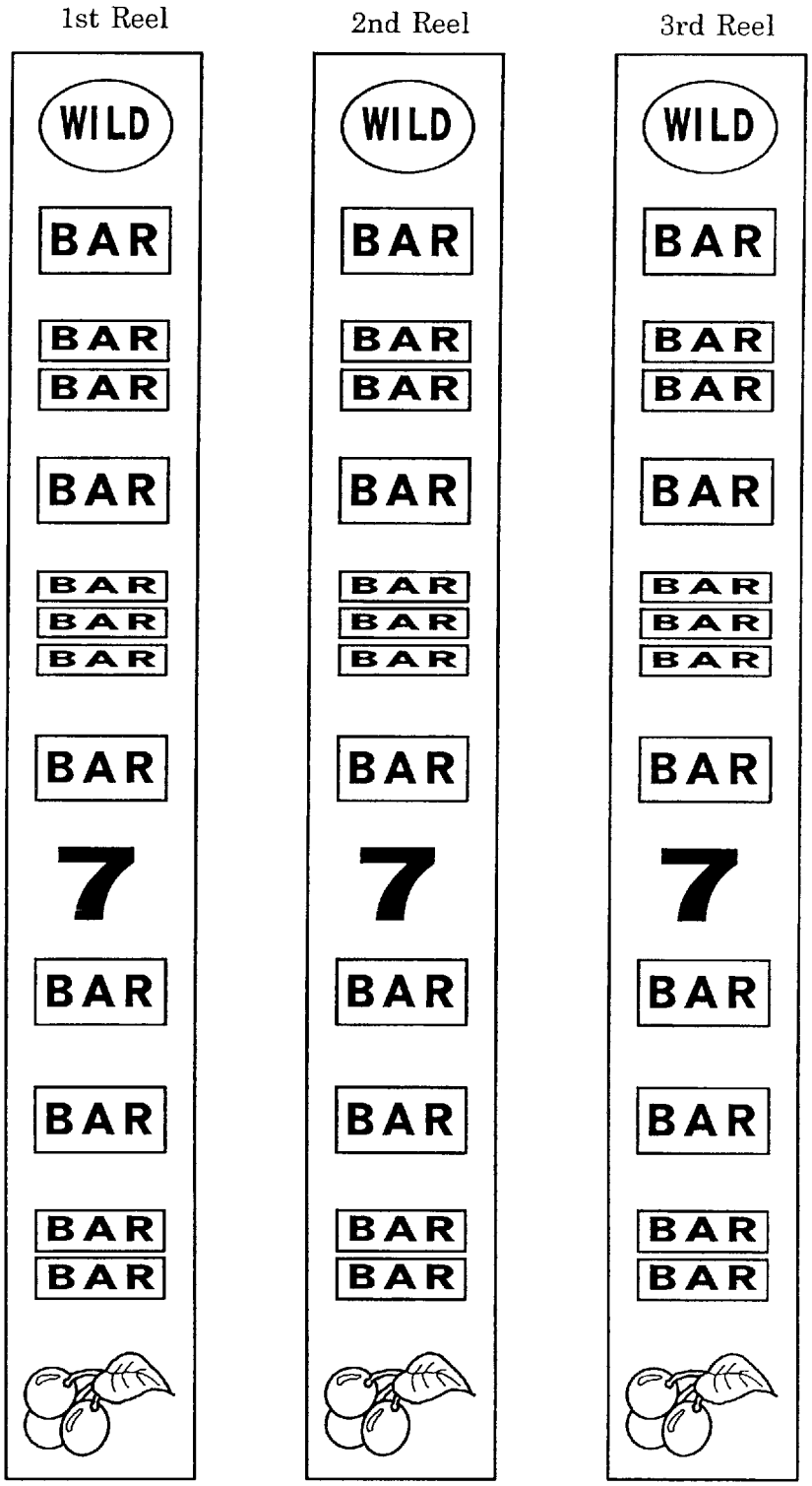
FIG. 2 is a diagram showing symbol columns illustrated on respective reels of the slot machine according to the embodiment.

FIG. 1 is a perspective view of a slot machine 1 according to the embodiment.

Three of a 1ST reel 3, a 2ND reel 4 and a 3RD reel 5 constituting a variable display apparatus are rotatably provided on the rear side of a reel glass 2 formed on the front face of the slot machine 1. Symbol columns comprising a plurality of kinds of picture patterns (hereinafter, referred to as symbol) are illustrated on outer peripheral faces of the respective reels 3, 4 and 5. As kinds of symbols, there are six kinds of a symbol "wild" described with 'WILD', a symbol "single bar" described with one of 'BAR', a symbol "two bars" described with two of 'BAR', a symbol "three bars" described with three of 'BAR', a symbol "seven" described with numeral '7' and a symbol "cherry" described with 'a picture pattern of cherry'.

Respective threes of the symbols are observed through display windows 6, 7 and 8 on the front face of the slot machine 1. One hit line 24 is illustrated on symbols respectively disposed at centers of the reels 3, 4 and 5. The reels 3, 4 and 5 start rotating by operating a handle 10 provided on a side face of a cabinet 9.

Further, a coin entry 12 in which a player puts coins and a bill entry 13 for inserting paper money are provided at a control panel 11 disposed below the reel glass 2. Further, the control panel 11 is provided with a spin switch 14 for starting to rotate the reels 3, 4 and 5 by push button operation separately from operation of the handle 10 and is further provided with a change switch 15, a cash out switch 16, a bet 1 switch 17 and a max bet switch 18.

Whether coins gained by a player are paid to a coin tray 20 via a coin payment output 19 or stored at inside of the machine as credit, is switched by the change switch 15. A number of coins credited to inside of the machine is displayed at a display portion 21 constituted by 7 segment LEDs (Light Emitting Diode). By operating the cash out switch 16, credited coins are paid to the coin tray 20 by push button operation. By operating the bet 1 switch 17, only one sheet of credited coins is betted on the game by one push button operation. By operating the max bet switch 18, a maximum number of sheets of coins capable of being betted on one game is betted on the game by one push button operation.

Further, there is shown an allotment display table indicating how much coins are paid to hits is displayed on a top glass 22 above the reel glass 2 and bottom glass 23 below the reel glass 2 is illustrated with characters or the like of the game machine.

FIG. 3 shows an example of an allotment display table displayed on the top glass 22. Respective columns of the table signify as follows starting from the lowest column.

That is, in the case in which the symbol "cherry" illustrated on any one of the reels 3 through 5 appears on the hit line 24 when all of the reels 3 through 5 are stopped, two sheets of coins are paid in the case of betting one sheet of coin, four sheets of coins are paid in the case of betting two sheets of coins and six sheets of coins are paid in the case of betting three sheets of coins. Further, in the case in which the symbols "cherry" illustrated on any two of the reels 3 through 5 appear on the hit line 24 when all of the reels 3 through 5 are stopped, in the case of betting one sheet of coin, five sheets of coins are paid, in the case of betting two sheets of coins, ten sheets of coins are paid and in the case of betting three sheets of coins, fifteen sheets of coins are paid.

Further, when any bars of "single bar", "two bars" and "three bars" are arranged on the hit line 24, regardless of an order of arranging kinds of bars, in the case of betting one sheet of coin, ten sheets of coins are paid, in the case of betting two sheets of coins, twenty sheets of coins are paid and in the case of betting three sheets of coins, thirty sheets of coins are paid.

Further, when three of the symbols "single bar" are arranged on the hit line 24, in the case of betting one sheet of coin, twenty sheets of coins are paid, in the case of betting two sheets of coins, forty sheets of coins are paid and in the case of betting three sheets of coins, sixty sheets of coins are paid. When three of the symbols "two bars" are arranged on the hit line 24, in the case of betting one sheet of coin, fifty sheets of coins are paid, in the case of betting two sheets of coins, one hundreds sheets of coins are paid and in the case of betting three sheets of coins, one hundred and fifty sheets of coins are paid. Further, when three of the symbols "three bars" are arranged on the hit line 24, in the case of betting one sheet of coin, eighty sheets of coins are paid, in the case of betting two sheets of coins, one hundred and sixty sheets of coins are paid and in the case of betting three sheets of coins, two hundred and forty sheets of coins are paid.

Further, when three of the symbols "seven" are arranged on the hit line 24, in the case of betting one sheet of coin, one hundred and fifty sheets of coins are paid, in the case of betting two sheets of coins, three hundreds sheet of coins are paid and in the case of betting three sheets of coins, four hundreds and fifty sheets of coins are paid. Further, when three of the symbols "wild" arranged on the hit line 24, in the case of betting one sheet of coin, two hundreds and fifty sheets of coins are paid, in the case of betting two sheets of coins, five hundreds sheets of coins are paid and in the case of betting three sheets of coins, one thousand sheets of coins are paid.

Further, on the top glass 22, there is displayed that when any one symbol in these hit combinations of symbols is replaced by the symbol "wild", a number of sheets of paying coins of the hit odds is doubled other than the hit combinations of symbols designated in the above-described allotment display table. For example, when two of the symbols "single bar" are arranged at any locations on the hit line 24 and one symbol "wild" appears at any location on the hit line 24, payment to the single bar hit becomes twice as much as the above-described. That is, in the case of betting one sheet of coin, there are paid forty sheets thereof twice as much as twenty sheets, in the case of betting two sheets of coins, there are paid eighty sheets thereof twice as much as forty sheets and in the case of betting three sheets of coins, there are paid one hundred and twenty sheets thereof twice as much as sixty sheets.

Further, on the top glass 22, there is also displayed that when any two of the symbols in the hit combinations of symbols indicated by the above-described allotment display table, are replaced by the symbols "wild", a number of sheets of paying coins of the hit odds is multiplied by four which is two times two. For example, when one symbol "single bar" appears at any location on the hit line 24 and two of the symbols "wild" are arranged at any locations on the hit line 24, payment to the single bar hit is multiplied by four. That is, in the case of betting one sheet of coin, there are paid eighty sheets thereof four times as much as twenty sheets, in the case of betting two sheets of coins, there are paid one hundred and sixty sheets thereof four times as much as forty sheets and in the case of betting three sheets of coins, there are paid two hundreds and forty sheets thereof four times as much as sixty sheets.

Figure 4:
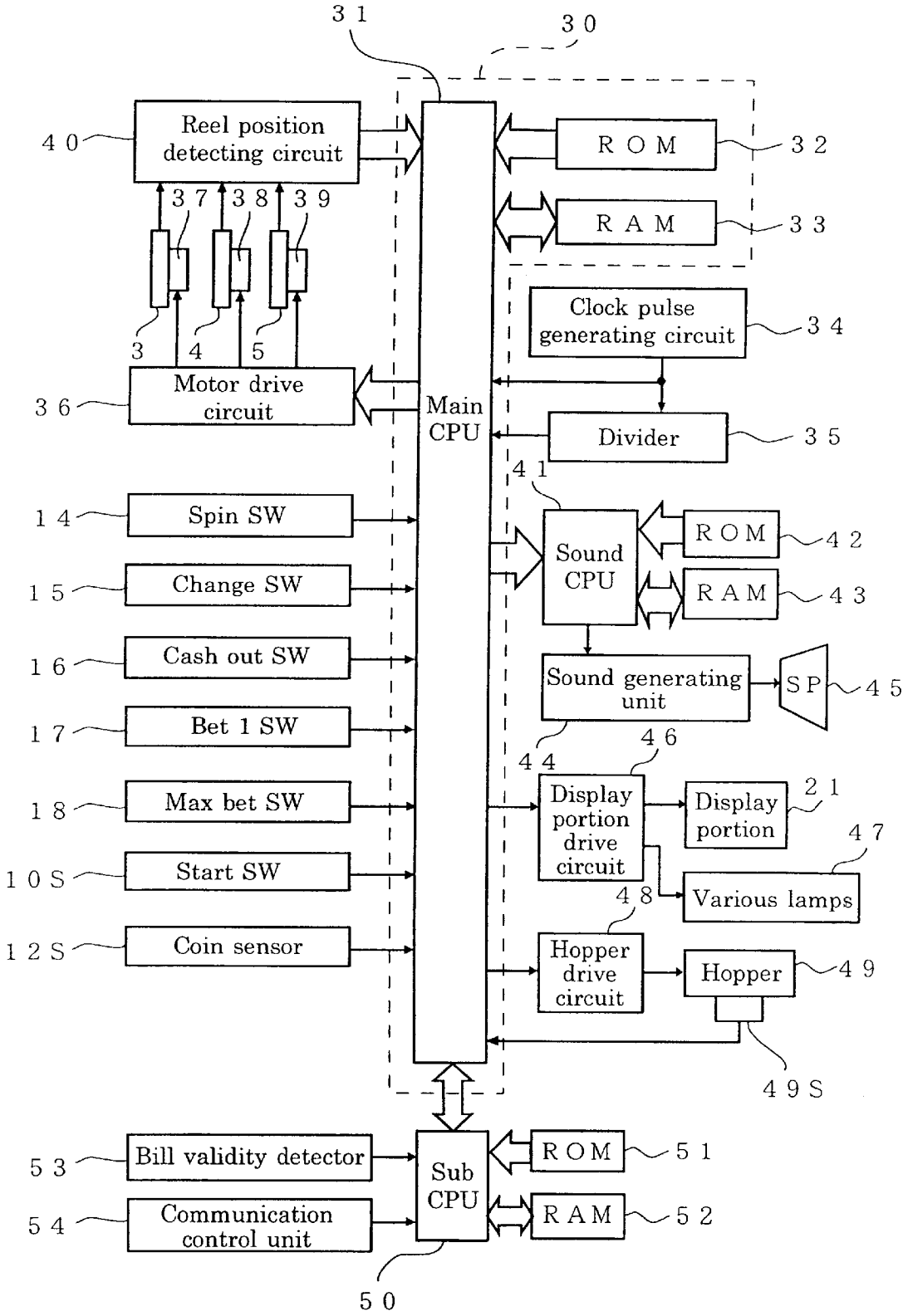
FIG. 4 is a block diagram showing a constitution of a principal control circuit of the slot machine according to the embodiment.

FIG. 4 shows a circuit constitution including a control unit for controlling game processing operation in the slot machine 1 of the embodiment and an attached equipment (actuators) electrically connected thereto.

The control unit is constituted by a microcomputer (hereinafter, referred to as micon) 30 as a principal constituent element and the micon 30 is constituted to include a main CPU (Central Processing Unit) 31 executing control operation in accordance with previously set programs, a ROM (Read Only Memory) 32 and a RAM (Random Access Memory; readable and writable memory) 33 which are storage means. The ROM 32 is stored with a control processing procedure of a total of the game machine as a program. The RAM 33 is used as a temporary storage work area when the program is executed.

Further, the CPU 31 is connected with a clock pulse generating circuit 34 for generating reference clock pulses and a divider 35 which are necessary for operating the CPU 31. The divider 35 generates interruption pulses for interrupting and executing programs.

The CPU 31 is connected with a start switch 10S and a coin sensor 12S other than the respective switches 14 through 18, mentioned above. The start switch 10S generates a signal of starting the reels 3 through 5 when a player operates the handle 10 and is made ON or OFF in connection with operation of the handle 10. The coin sensor 12S detects proper coins inputted from the coin entry 12 and selected by a coin selecting apparatus.

Further, a motor drive circuit 36 connected to the CPU 31 controls respective stepping motors 37, 38 and 39 for driving to rotate the reels 3, 4 and 5 and a reel position detecting circuit 40 detects rotational positions of the respective reels 3, 4 and 5 and outputs the detected rotational positions to the CPU 31.

Further, the CPU 31 is connected with a sound CPU 41 and the sound CPU 41 controls a sound generating portion 44 in accordance with programs stored in a sound ROM 42 and outputs various game sounds from a speaker 45 as effective sounds. A sound RAM 43 is used as a temporal storage work area in processing to control the sound CPU 41.

Further, the CPU 31 is connected with a display portion drive circuit 46 and a hopper drive circuit 48 and the display portion drive circuit 46 controls to light the credit number display portion 21, mentioned above, and various lamps 47. The hopper drive circuit 48 drives a hopper 49 in paying coins and pays coins contained in the hopper 49 to the coin tray 20. Paid coins are detected by a paid coin sensor 49S and a number of detected coins is given to the CPU 31.

Further, the CPU 31 is connected with a sub CPU 50 and the sub CPU 50 controls a bill validity detector 53 and a communication control unit 54 in accordance with programs stored to the ROM 51. A RAM 52 is used as a temporal storage work area in control processings by the CPU 50. The bill validity detector 53 detects paper money inserted into the bill entry 13 and the communication control unit 54 controls communication with a host computer of a game center.

According to the embodiment, the hopper drive circuit 48, the hopper 49, the coin sensor 49S, the credit number display unit 21 and the micon 30 constitute dividedly paying means for paying coins of one hit by dividing the paying operation in plural times. Further, the motor drive circuit 36, the respective stepping motors 37 through 39, the reels 3 through 5, the reel position detecting circuit 40 and the micon 30 constitute display staging means for staging a display to the player among payments by the above-described dividedly paying means.

Next, an explanation will be given of an outline of operation of the game machine controlled by the micon 30 according to the embodiment in reference to flowcharts of FIG. 5 and FIG. 6.

Figure 5:
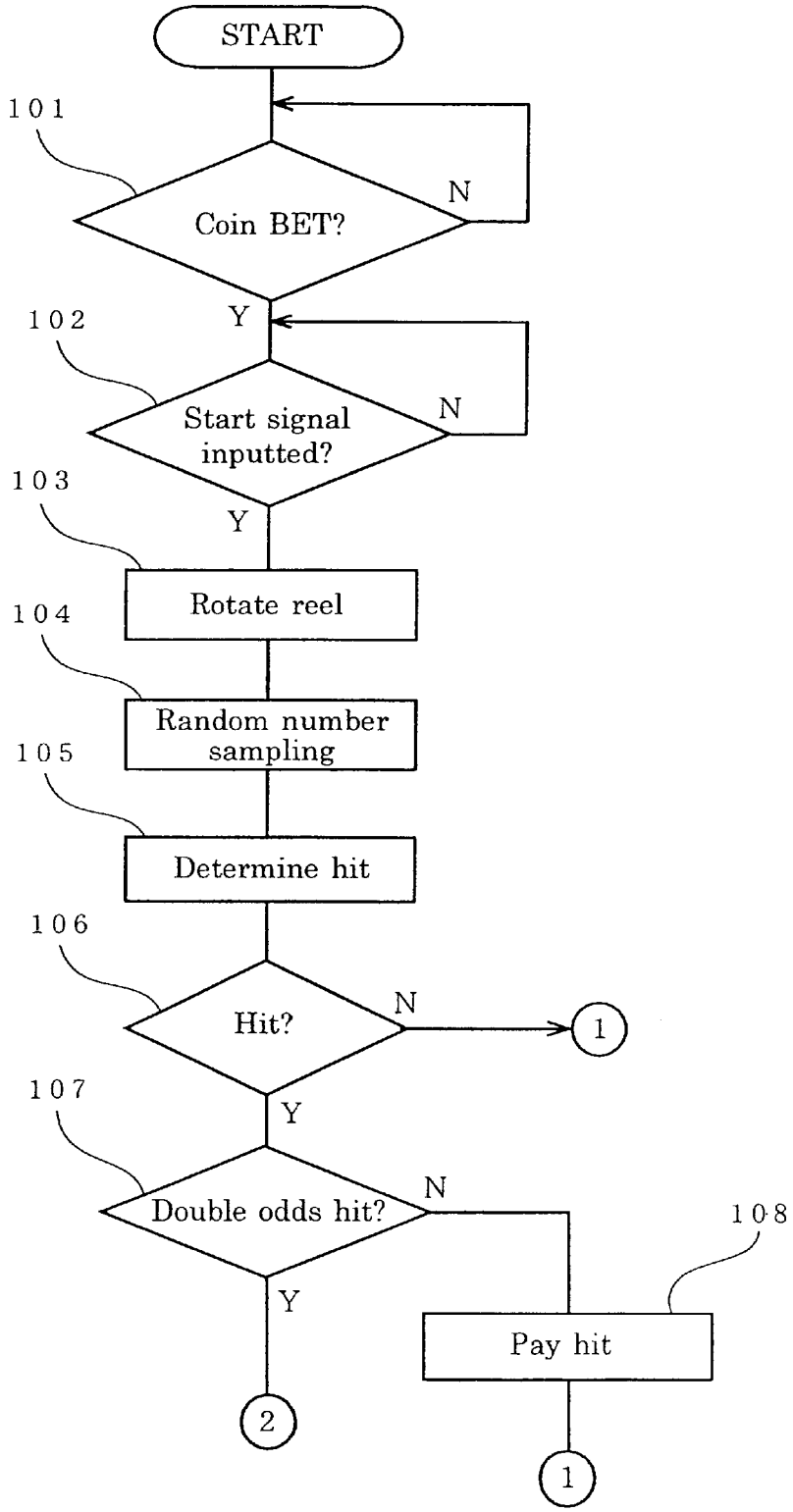
FIG. 5 is a first flowchart showing an outline of play processings of the slot machine according to the embodiment.
Figure 6:
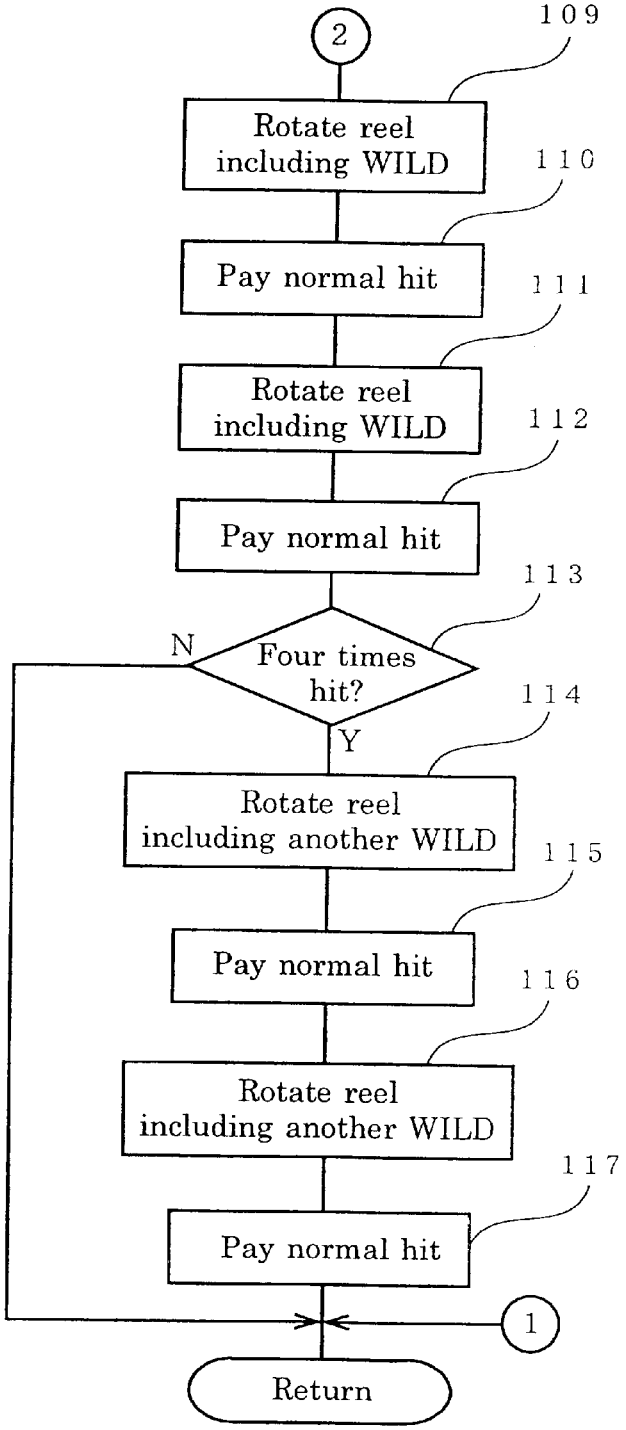
FIG. 6 is a second flowchart showing an outline of play processings of the slot machine according to the embodiment.

First, the CPU 31 determines whether coin BET is carried out (FIG. 5, step 101). The determination is "YES" when coins are put into the coin entry 12 and a detected signal is inputted from the coin sensor 12S or when a signal is inputted from the bet 1 switch 17 or the max bet switch 18. In that case, successively, the operation determines whether a start signal is inputted from the start switch 10S or the spin switch 14 (step 102).

When the determination is "YES", the CPU 31 drives to rotate the reels 3 through 5 by transmitting a drive signal to the motor drive circuit 36 (step 103) and executes random number sampling (step 104). The random number sampling is executed by storing to the RAM 33, a numerical value produced by adding a predetermined number (for example, 3) to one integer in a predetermined range (for example, 0 through 127) generated from an R resistor in the CPU 31 at each time of inputting the reference clock pulse from the clock pulse generating circuit 34, and reading the numerical value stored to the RAM 33 at each time of executing operation by interruption. Further, the numerical value stored to the RAM 33 is updated at each time of inputting the reference pulse.

Next, the operation executes hit determination based on the random number value sampled as described above (step 105). The hit determination is executed by comparing a hit probability table previously stored in the ROM 32 with the sampled random number value and a flag in accordance with a result of the hit determination is erected in the RAM 33. Further, the operation determines whether a result of the hit determination at current time produces a hit (step 106) and in the case of blank producing no hit, the result of the determination is "NO" and the operation returns to the initial processing and the above-described processings are repeated.

Further, the result of the determination in the case of producing a hit becomes "YES", successively, it is determined whether the hit is a double odds hit related to the wild symbols, mentioned above (step 107). When the hit is not the double odds hit, coins having a number of sheets of a normal hit in accordance with the above-described allotment display table are paid (step 108), thereafter, the operation returns to the initial processing.

Further, when the result of the determination at step 107 is the double odds hit, successively, the motor drive circuit 36 is controlled by the CPU 31, any one of the stepping motors 37 through 39 of the reels 3 through 5 including the symbol "wild" is driven to rotate and any one of the reels 3 through 5 including the symbol "wild" is rotated by one rotation (step 109).

Figure 7A:
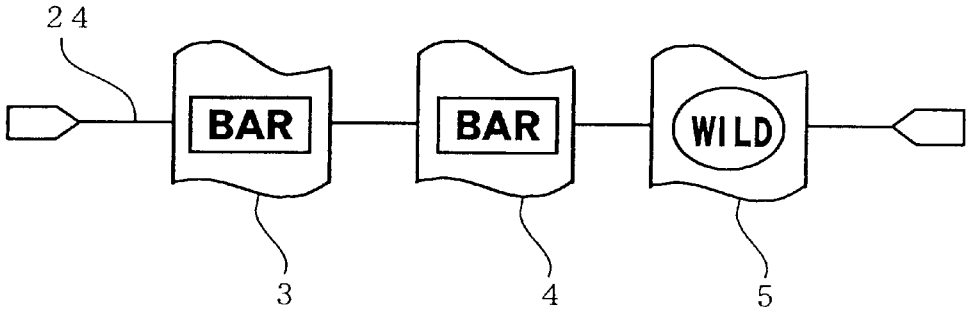
FIG. 7A and FIG. 7B are views indicating hit combinations of symbols including specific picture patterns used in the slot machine according to the embodiment.
Figure 7B:
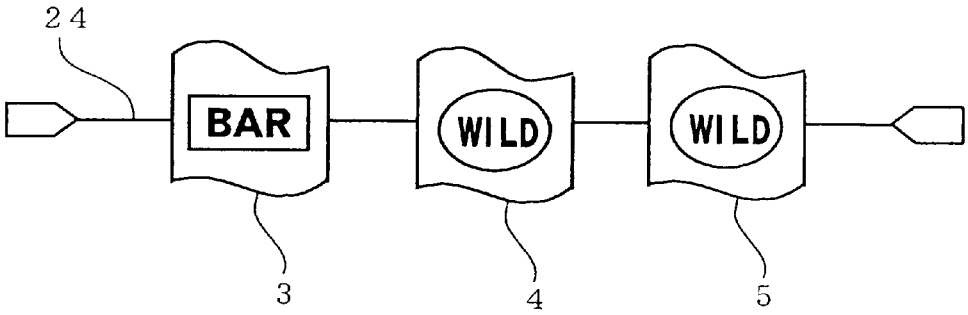

For example, when the symbol "wild" is included in the 3RD reel 5 as shown by FIG. 7A, only the 3RD reel is rotated by one rotation. Further, when the symbols "wild" are included in the 2ND reel 4 and the 3RD reel 5 as shown by FIG. 7B, for example, only one of them or the 2ND reel 4 is rotated by one rotation.

After the reel rotating processing, successively, coins having a number of sheets of the normal hit are paid (step 110). For example, in both of the cases of the single bar hit of double odds shown by FIG. 7A and the single bar hit of four times odds shown by FIG. 7B, in accordance with the allotment display table shown by FIG. 3, in the case of betting one sheet of coin, twenty sheets of coins are paid, in the case of betting two sheets of coins, forty sheets thereof are paid and in the case of betting three sheets of coins, sixty sheets thereof of coins are paid.

The payment operation is controlled by the CPU 31 and is carried out to drive the hopper 49 by the hopper driving circuit 48 and pay coins actually to the coin tray 20 or to increase the credit number stored to the RAM 33 by the CPU 31 and increase the credit number displayed on the display portion 21 by controlling the display portion drive circuit 46. The switching of payment is carried out by the change switch 15 as mentioned above.

Next, any of the reels 3 through 5 including the symbol "wild" is rotated again by one rotation similar to step 109 (step 111). Thereafter, coins of the normal hit in accordance with the allotment display table are paid again similar to step 110 (step 112).

Next, it is determined whether the odds hit is a hit of four time odds including two of the symbols "wild" (step 113). When the hit is not the hit of the four times odds, the operation returns to the initial processing. Meanwhile, in the case of the hit of the four times odds, successively the motor drive circuit 36 is controlled by the CPU 31 and any one of the reels 3 through 5 including another of the symbol "wild" is rotated by one rotation. For example, in the case in which the hit of the four times odds is the hit of a mode shown by FIG. 7B, and the 2ND reel 4 has been rotated at steps 109 and 111, the 3RD reel 5 is rotated by one rotation by the processing at step 114.

Next, coins having a number of sheets of the normal hit in accordance with the allotment display table are paid similar to steps 110 and 112 (step 115). Thereafter, any one of the reels 3 through 5 including another of symbol "wild" is rotated by one rotation similar to step 114 (step 116), further, coins having a number of sheets of the normal hit in accordance with the allotment display table are paid similar to step 115 (step 117).

According to the embodiment, even when a number of sheets of coins to be paid is large, the coins are paid dividedly in plural times by the dividedly paying means and the display staging means stages the display to the player between payments For example, when game is carried out by betting three sheets of coins and single bar hit of double odds shown by FIG. 7A is produced, although according to the conventional slot machine, coins of 120 sheets (=60 sheets×2 times) are summarizingly paid to the coin tray 20, according to the embodiment, 60 sheets of coins for the normal hit are paid dividedly in two times. Further, in the case of producing single bar hit of four times odds as shown by FIG. 7B, although according to the conventional slot machine, 240 sheets (=60 sheets×4 times) of coins are summarizingly paid to the coin tray 20, according to the embodiment, 60 sheets of coins of the normal hit are paid in four times in a divided manner. Further, between respective payments, as mentioned above, the display is staged to the player by the reels 3 through 5.

Normally, the larger the allotment becomes, the longer a time period of payment becomes and the player simply waits during the time period, however, according to the embodiment, as mentioned above, the payment is stopped at a number of times during the operation and accordingly, an impression of "Is the machine destroyed?" is given to the player and stirs waves of sentiment mixed with expectation and anxiety. Therefore, according to the embodiment, a variation is provided to payment of coins which has been conventionally monotonous, further, the player can enjoy staging display of the reels 3 through 5 during the payment operation. Further, when coins are paid by dividing the coins into small lots in this way, the player is brought under illusion as if a number of sheets of coins to be paid were more than an actually paid amount.

Further, when the payment is divided as credit, a numerical value of credit displayed on the credit number display portion 21 is increased in steps in plural times, the display is staged by the reels 3 through 5 between increases of the respective values of credit. Therefore, in comparison with the conventional slot machine in which the numerical value of credit is summarizingly increased instantaneously, the player can feel that a large number of coins are gained.

Further, according to the embodiment, there is constructed a constitution in which when a combination of hit symbols including the symbol "wild" is stopped to display on the hit line 24, payment of coins with regard to one time hit is carried out in plural times. Therefore, the player can taste moments of payment at a number of times in accordance with allotments of the symbol "wild". Further, by repeating these payment, characterization with regard to the symbol "wild" is unconsciously carried out, expectation to the symbol "wild" is promoted and the player can enjoy all the more.

Therefore, conventionally, the symbol "seven" has been recognized by the player as a symbol constituting high odds, however, the player also pays attention to the symbol "wild" and the degree of recognizing the symbol "wild" is promoted. Further, according to the embodiment, the display is staged among respective payments by any of the reels 3 through 5 including the symbol "wild" and accordingly, the player pays more attention to the symbol "wild" and the degree of recognizing the symbol "wild" is further promoted.

Further, although according to the above-described embodiment, an explanation has been given of the case in which a sum of paying hit odds including the symbol "wild" is doubled and paid in twice, however, the payment may constitute three times thereof and coins may be paid dividedly in three times. In this way, when payment of coins to one hit is carried out dividedly in a multiple of odds allotted to the symbol "wild", meaning of odds of the symbol "wild" becomes clear.

Further, although according to the above-described embodiment, the reel staging display carried out among respective payments is executed by a processing of rotating any of the reels 3 through 5 by one rotation, however, any of the reels 3 through 5 may be rotated by the multiple of odds allotted to the symbol "wild". That is, in the case of double odds of the symbol "wild", any of the reels 3 through 5 is rotated by two rotations among the respective payments and in the case of the three times odds, any of the reels 3 through 5 is rotated by three rotations among the respective payments. By such a staging display, meaning of odds of the symbol "wild" is made further clear.

Further, although according to the above-described embodiment, an explanation has been given with the display staging means as the rotating reels 3 through 5, display staging means may be constituted by a video monitor or a liquid crystal display apparatus displaying rotation of the reels 3 through 5 in place thereof and also in this case, an effect similar to that in the above-described embodiment is achieved.

Although the present invention has been explained in reference to the embodiments, it is apparent for those skilled in the art that many changes and modifications can be made without departing from the spirit and scope of the invention, as clear from the following claims.

What is claimed is:

1. A game machine having a variable display apparatus for variably displaying various picture patterns in a plurality of columns, producing a hit when a predetermined combination of the picture patterns is stopped to display on a hit line and paying game media of an amount in accordance with a kind of the hit to a player, wherein said game machine comprises:

dividedly paying means for paying the game media of one hit dividedly in plural times; and display staging means for staging a display to the player between payments by the dividedly paying means.

2. A game machine according to claim 1:

wherein the display staging means is constituted by the variable display apparatus.

3. A game machine according to claim 2:

wherein the dividedly paying means pays the game media of one hit dividedly in plural times when a predetermined one of the combinations of picture patterns including a specific picture pattern is stopped to display on the hit line.

4. A game machine according to claim 3:

wherein the display staging means stages the display of the variable display apparatus by executing a variable display of the columns including the specific picture pattern.

5. A game machine according to claim 4:

wherein the dividedly paying means pays the game media of one hit dividedly in a multiple of odds allotted to the specific picture pattern when the specific picture pattern constitutes the odds for multiplying an amount of paying the game media to the hit by the multiple.

6. A game machine according to claim 5:

wherein the display staging means executes one time variable display of the columns including the specific picture pattern of the variable display apparatus by the multiple of the odds allotted to the specific picture pattern when the specific picture pattern constitutes the odds for multiplying the amount of paying the game media to the hit by the multiple.

7. A game machine according to claim 6:

wherein the game machine is a slot machine.

* * * * *